US006425558B1

(12) United States Patent
Saunders

(10) Patent No.: US 6,425,558 B1
(45) Date of Patent: Jul. 30, 2002

(54) CARGO EXTENSION FRAME

(76) Inventor: George D. Saunders, 201 Yoakum Pkwy., Unit 51, Alexandria, VA (US) 22304-3751

( * ) Notice: Subject to any disclaimer, the term of this patent is extended or adjusted under 35 U.S.C. 154(b) by 0 days.

(21) Appl. No.: 09/546,221

(22) Filed: Apr. 10, 2000

(51) Int. Cl.[7] ..... F16M 11/38

(52) U.S. Cl. ..... 248/166; 248/429; 248/168; 248/439; 108/143

(58) Field of Search ..... 248/166, 429, 248/165, 168, 170, 439, 440, 188.6, 903, 49; 108/143, 22, 140, 159; 211/189, 187, 182, 186, 184

(56) References Cited

U.S. PATENT DOCUMENTS 1,840,844 A * 1/1932 Krema ..... 248/166 X
2,022,399 A * 11/1935 Beiger ..... 311/98
2,182,703 A * 12/1939 Rainwater ..... 45/6
3,042,221 A * 7/1962 Rasmussen ..... 211/148
3,285,428 A * 11/1966 Scheck ..... 211/148
3,463,325 A * 8/1969 Zagotta et al. ..... 211/148
3,491,706 A * 1/1970 Glass ..... 108/125
4,048,059 A * 9/1977 Evans ..... 108/155
4,078,664 A * 3/1978 McConnell ..... 211/189
4,144,984 A 3/1979 Saunders
4,209,887 A 7/1980 Saunders
4,360,115 A 11/1982 Saunders
4,653,408 A * 3/1987 Nagashima et al. ..... 108/20
4,729,536 A * 3/1988 Scala ..... 248/429
5,074,503 A * 12/1991 McDonald et al. ..... 248/167
5,660,121 A * 8/1997 Botts et al. ..... 108/132
5,666,888 A * 9/1997 Dame et al. ..... 108/144
6,189,429 B1 * 2/2001 Liu ..... 83/477

* cited by examiner

*Primary Examiner*—Leslie A. Braun
*Assistant Examiner*—A. Joseph Wujciak
(74) *Attorney, Agent, or Firm*—Norman E. Lehrer

(57) ABSTRACT

A metal frame structure designed to fit and attach on top of a half height ISO open top container. This extends the vertical height to which general cargo can be loaded and secured in a half height open top container. The cargo extension frame also serves as a securing structure for cargo items of irregular sizes and shapes or in circumstances where the upper portion of a cargo item may be top heavy or difficult to block and brace. When the cargo extension frame is not in use, the four vertical legs can be folded parallel to the underside of the left and right side longitudinal rails to facilitate handling and storage.

2 Claims, 2 Drawing Sheets

CARGO EXTENSION FRAME

BACKGROUND OF THE INVENTION

The present invention is directed to the art of containerized transport of bulk or manufactured cargo wherein efficient loading, unloading, securing, and enhanced container equipment utilization is essential and, more particularly, toward a cargo extension frame for use with a half height open top container.

By far the majority of containers in existence and in service today are of the closed construction type, affording protection from the elements and physical security of their cargo. A number of other containers are half size in height and do not have upper side wall and roof construction. These half height open top containers transport cargoes of high density, or irregular size and/or shapes that can withstand the weather elements. At times the half height open top container is in great demand but for much of the time they stand idle. The object of this invention is to fit them with a device that will increase their productivity as well as provide maximum cargo security and restraint capability.

SUMMARY OF THE INVENTION

The concept of the instant invention involves the provision of greater utilization of the International Standards Organization (ISO) half height open top container. This is accomplished by fitting a frame structure of the same size as the half height open top container, on said container. This will create a full size ISO container although there will be no upper half side walls or roof. These exposed surfaces will be covered by tarpaulins or other weather protective materials.

It is an object of this invention to provide the mechanical means to extend in a safe and secure manner the cubic cargo capacity of the half height open top container. The cargo extension frame provides full size form and definition in keeping with intermodal characteristics.

It is a further object of this invention to construct the cargo extension frame with transverse members, between the left and right side longitudinal rails, that can be positioned over the length of the longitudinal rails as necessary to secure or brace cargo from the top. This relieves the stress on side and floor based securing points within the container envelope.

Another object of this invention is to construct the four vertical legs of the cargo extension frame so that they will fold upwards under the left and right side longitudinal rails when the cargo extension frame is not in use.

A still further object of this invention is to size the dimensions and strength requirements of the cargo extension frame so that the half height open top container, fitted with the cargo extension frame, can be carried in the vertical cells of a containership; in a situation where ISO containers are stacked one upon another for ocean transportation.

Another object of this invention is to provide a cargo extension frame that will serve as a support for a form fitting tarpaulin that will cover five surfaces between the top rails of the half height open top container, up and over the cargo extension frame.

The support structure of the present invention is superior to the structures of the prior art which generally fail to provide the versatility needed and provided by the invention. The prior art also fails to disclose a device which increases the cargo capacity or utilization of equipment. In addition, commercially available devices in the container transport field do not involve the concept of a detachable unit capable of increasing cargo accommodation capacity and enhancing cargo security arrangements.

Other objects, features, and advantages of the invention will be readily apparent from the following detailed description of the preferred embodiment thereof taken in conjunction with the drawings.

BRIEF DESCRIPTION OF THE DRAWINGS

For the purpose of illustrating the invention, there is shown in the accompanying drawings one form which is presently preferred: it being understood that the invention is not intended to be limited to the precise arrangements and instrumentalities shown.

DETAILED DESCRIPTION OF THE PREFERRED EMBODIMENTS

Figure 1:
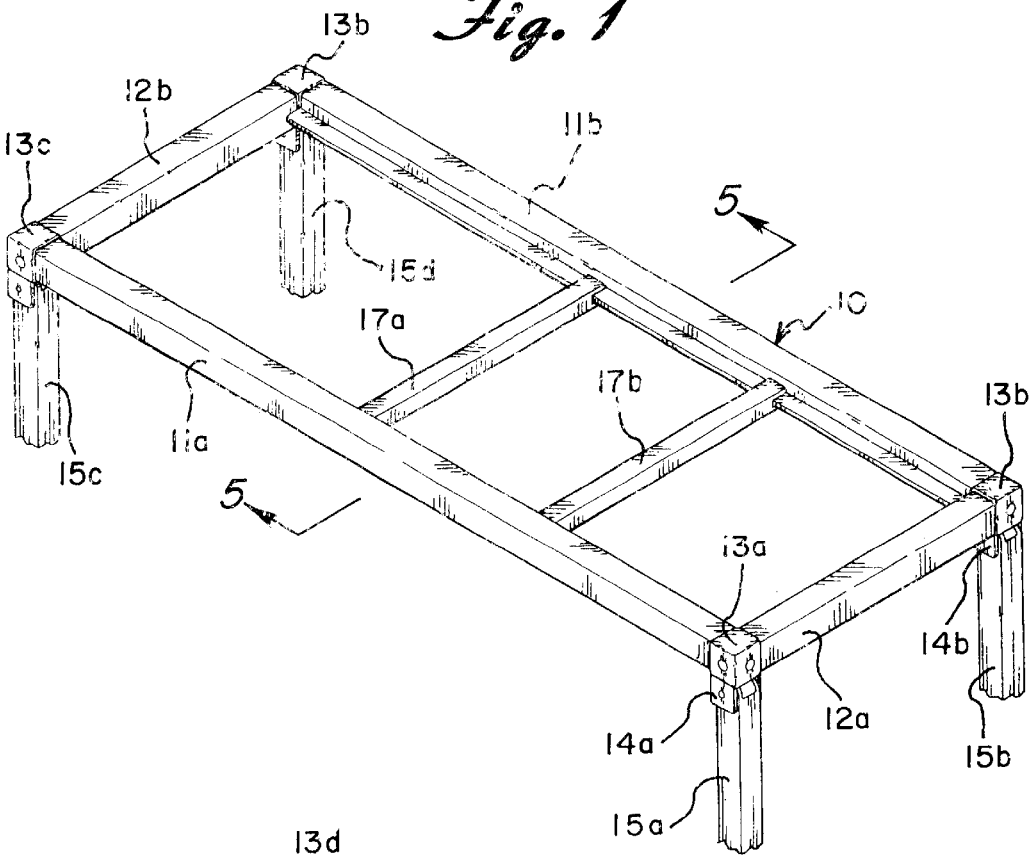
FIG. 1 is a perspective view of the cargo extension frame of the present invention with portions broken away for clarity and showing the four legs in there extended vertical position.
Figure 2:
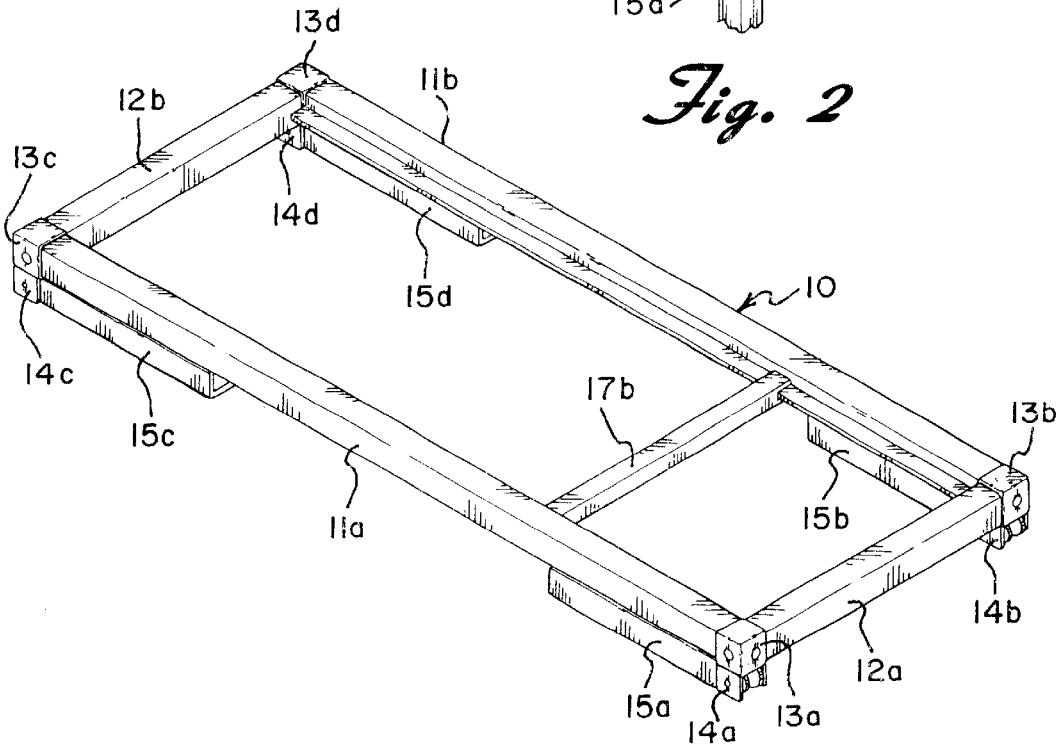
FIG. 2 is a perspective view of the cargo extension frame of FIG. 1 showing the four legs folded under the left and right side longitudinal rails.

Referring now to the drawings in detail wherein like reference numerals have been used throughout the various figures to designate like elements, there is shown in FIGS. 1 and 2 a cargo extension frame constructed in accordance with the principles of the present invention and designated generally as 10. The cargo extension frame 10 is comprised essentially of a pair of parallel opposed tubular longitudinal members 11*a* and 11*b* and a pair of parallel end members 12*a* and 12*b*. Corner castings, such as shown at 13*a*, 13*b*, 13*c*, and 13*d*, connect the members 11*a* and 11*b* to the members 12*a* and 12*b* together at their respective ends in any known manner such as by welding to form a rectangular frame as shown in FIGS. 1 and 2. 13. The corner castings are preferably built according to the specifications of the International Standards Organization.

Figure 4:
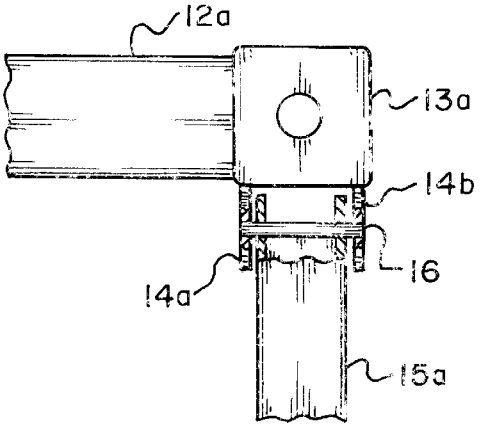
FIG. 4 is a partial end elevational view of the cargo extension frame of FIG. 1 showing the transverse header and ISO corner casting leg arrangement.
Figure 5:
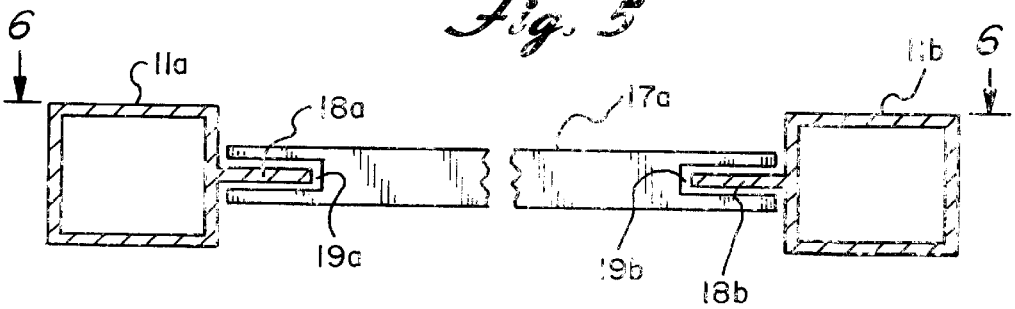
FIG. 5 is a partial cross-sectional view taken through the lines 5—5 of FIG. 1 showing an overhead cargo securing bar fitted between the longitudinal rails.
Figure 6:
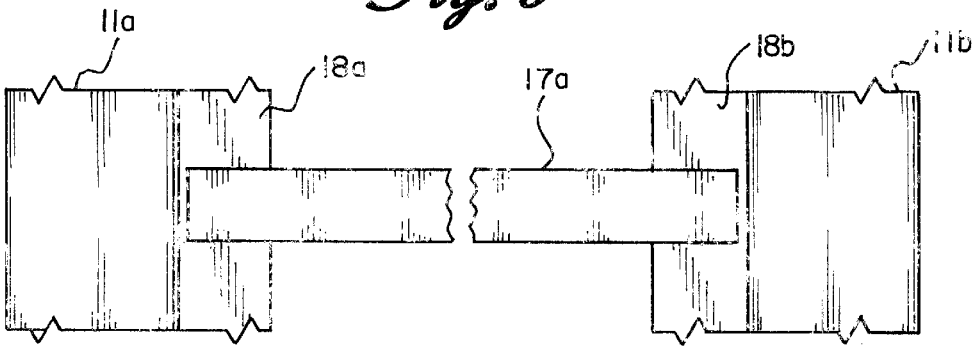
FIG. 6 is a top plan view showing the overhead cargo securing bar fitted between the left and right longitudinal rails.

Attached to the bottom of each of the four corner castings, such as corner casting 13*a* is a pair of vertically attached parallel flanges such as shown at 14*a* and 14*b* in FIG. 4. The flanges are in a longitudinal position in alignment with the longitudinal rail members 11. Although only one pair of flanges 14*a* and 14*b* is shown in detail in FIG. 4, it will be understood that a similar pair of flanges is secured to the bottom of each of the corner castings.

Figure 3:
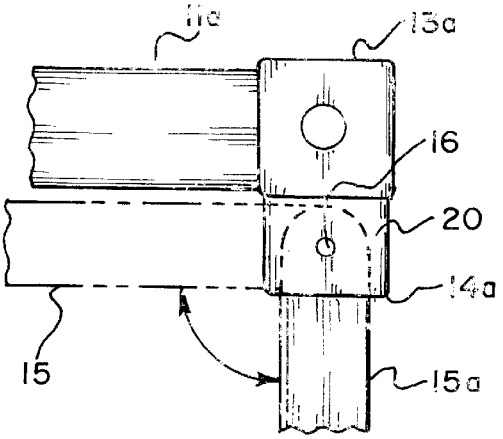
FIG. 3 is a partial front elevational view of the cargo extension frame of FIG. 1 showing an ISO corner casting with flanges attached for supporting the vertical leg pin.

Each pair of flanges has the upper end of a vertical leg 15*a*, 15*b*, 15*c* or 15*d* hinged thereto. Attachment is by a horizontally positioned pin such as 16*a* shown in FIG. 4 that will permit the leg member 15*a*, for example, to rotate in a ninety degree arc from the vertical position shown in FIGS. 1, 3 and 4 to the stored position underneath and parallel to the longitudinal rails as shown in FIGS. 2 and 3. Each corner casting is provided with a vertical back stop bar such as shown at 20*a* in FIG. 3 which is fitted between the flanges

14*a* and 14*b* and which restricts the leg 15*a* from moving passed the vertical position.

Although not specifically shown, the bottom of each of the four vertical legs 15*a*, 15*b*, 15*c* and 15*d* is fitted with a twist lock which will engage the ISO corner casting at each of the top four corners of the half height open top container to which the cargo extension frame 10 of the present invention is to be mounted.

It should be noted that the length, width and height dimension of the cargo extension frame, and half height open top container on which the frame is mounted, are functions of each other. They are of uniform multiples of each other to facilitate varied stacking thereby more effectively utilizing available storage space.

To provide for the securing of cargo, particularly the upper-most portions of the cargo projecting above the side walls of the half height open top container, an arrangement of transverse securing bars such as shown at 17*a* and 17*b* are fitted between the left and right longitudinal rails 11*a* and 11*b*. Preferably these securing bars 17*a* and 17*b* are movable over substantially the entire length of the longitudinal rails 11*a* and 11*b*.

To accommodate the securing bars 17*a* and 17*b*, the inward face of each of the left and right longitudinal rails 11*a* and 11*b* includes a horizontally extending projection such as shown at 18*a* and 18*b* that fit into complementary recesses 19*a* and 19*b* formed in the ends of the securing bars 17. This arrangement allows for longitudinal movement of the securing bars while preventing vertical movement thereof. This permits the cargo securing bars to be positioned as needed over the items of cargo that can benefit from top down stabilization and securing. The cargo locking bars also serve as roof bows to support tarpaulins should the cargo need protection from the elements. Although the securing bars 17 may be freely movable along the length of the rails 11*a* and 11*b*, they can not move in the vertical direction, either upwardly or downwardly.

It will thus be appreciated that there has been provided a cargo extension frame that will effectively double the cubic cargo capacity of a half height open top container. The cargo expansion frame also has a means for providing additional cargo securing capability. It is to be further understood that the cargo extension frames are singular structures and can be attached to different half height open top containers as market conditions may require. With vertical legs folded under the left and right side longitudinal rails, the cargo extension frame can easily be moved from one location to another to meet operational and shipper requirements.

The present invention may be embodied in other specific forms without departing from the spirit or essential attributes thereof and accordingly, reference should be made to the appended claims rather than to the foregoing specification as indicating the scope of the invention.

I claim:

1. A cargo extension frame particularly adapted to be attached to the top of a half height open top shipping container, said extension frame comprising:

first and second spaced apart longitudinally extending rail members;

first and second spaced apart transversely extending rail members;

four corner castings, each of said corner castings being connected to a different end of a different one of said rail members so as to form a substantially rectangularly shaped frame;

a leg pivotally connected to each of said corner castings and movable between a vertically extending operable position and a horizontally extending inoperable position, and at least one securing bar extending transversely between said longitudinal rails at a position within said substantially rectangularly shaped frame, said securing bar being movable along said longitudinal rails;

wherein each of said longitudinal rails includes a horizontally extending inwardly facing projection throughout substantially the entire length thereof and wherein said securing bar includes a horizontally extending recess adjacent each end thereof adapted to cooperate with said projections thereby allowing longitudinal movement of said bar but preventing vertical movement thereof.

2. A cargo extension frame particularly adapted to be attached to the top of a half height open top shipping container, said extension frame comprising:

first and second spaced apart longitudinally extending rail members;

first and second spaced apart transversely extending rail members;

four corner castings, each of said corner castings being connected to a different end of a different one of said rail members so as to form a substantially rectangularly shaped frame;

a leg pivotally connected to each of said corner castings and movable between a vertically extending operable position and a horizontally extending inoperable position, and a plurality of securing bars extending transversely between said longitudinal rails at a position within said substantially rectangularly shaped frame, each of said securing bars being movable along said longitudinal rails;

wherein each of said longitudinal rails includes a horizontally extending inwardly facing projection throughout substantially the entire length thereof and wherein each of said securing bars includes a horizontally extending recess adjacent each end thereof adapted to cooperate with said projections thereby allowing longitudinal movement of each of said bars but preventing vertical movement thereof.

* * * * *